US005890924A

United States Patent [19]

Endo et al.

[11] Patent Number: 5,890,924

[45] Date of Patent: Apr. 6, 1999

[54] INSULATION-DISPLACEMENT-CONTACT CONNECTOR

[75] Inventors: Mitsuo Endo; Yuji Hatagishi, both of Shizuoka-ken, Japan

[73] Assignee: Yazaki Corporation, Tokyo, Japan

[21] Appl. No.: 786,630

[22] Filed: Jan. 21, 1997

[30] Foreign Application Priority Data

Jan. 22, 1996 [JP] Japan ..... 8-008574

[51] Int. Cl.[6] ..... H01R 4/24

[52] U.S. Cl. ..... 439/417; 439/404; 439/942

[58] Field of Search ..... 439/404, 395, 439/417, 399, 402, 405, 407, 456, 457, 461, 942

[56] References Cited

U.S. PATENT DOCUMENTS

| | | | |
|---|---|---|---|
| 4,062,616 | 12/1977 | Shaffer et al. | 439/404 |
| 4,435,034 | 3/1984 | Aujla et al. | 439/404 |
| 4,648,677 | 3/1987 | Lang | 439/404 |
| 4,674,819 | 6/1987 | Fujitani et al. | 439/404 |
| 4,938,711 | 7/1990 | Davis et al. | 439/405 |
| 4,964,811 | 10/1990 | Hayes, Sr. et al. | 439/402 |
| 4,995,827 | 2/1991 | Rudoy | 439/417 |
| 5,011,430 | 4/1991 | Haitmanek | 439/456 |
| 5,421,741 | 6/1995 | David et al. | 439/405 |
| 5,660,559 | 8/1997 | Yamamoto et al. | 439/395 |
| 5,735,706 | 4/1998 | Ito | 439/402 |

FOREIGN PATENT DOCUMENTS 60-16109 1/1985 Japan .

*Primary Examiner*—Neil Abrams
*Assistant Examiner*—Brian J. Biggi
*Attorney, Agent, or Firm*—Finnegan, Henderson, Farabow, Garrett & Dunner, L.L.P.

[57] ABSTRACT

Disclosed is an insulation-displacement-contact connector comprising a first frame, a second frame, and tabs. The first and second frames pinch electric wires tight between them when assembled together. The first frame has an opening so that the insulation-displacement-contact pins of a mating material can pass through and touch the wires. The tabs on the second frame extend outwardly at an angle and bend exposed portions of the wires along the outer surfaces of the first frame, making the wires gripped more securely against pushing force exerted by the insulation-displacement-contact pins.

8 Claims, 3 Drawing Sheets

INSULATION-DISPLACEMENT-CONTACT CONNECTOR

BACKGROUND OF THE INVENTION

The present invention relates to an insulation-displacement-contact connector.

The connector assembly as disclosed in Japanese Patent Laid-Open No. 60-16109 comprises a female connector on the upper side of an electrical junction box and a separate male connector which can mate with the female connector. The female connector houses plug pins which are integral with a bus bar. The male connector houses socket pins. When the female and male connectors mate, their plug and socket pins also mate, ensuring electrical contact between them.

The connector as disclosed in U.S. Pat. No. 5,421,741 comprises a connector housing which can hold electric wires. The connector can be inserted into a mating material which has protruding insulation-displacement-contact pins. When the connector is inserted into the mating material, the insulation-displacement-contact pins cut through wire insulation to reach metal conductors inside, ensuring electrical contact between the pins and the wires.

The connector assembly according to Japanese Patent Laid-Open No. 60-16109 uses pins on each of the female and male connectors, and thereby costs more than a connector assembly requiring pins only on its female connector. The connector according to U.S. Pat. No. 5,421,741 is not reliable enough to hold wires tight in its connector housing so that the wires will not get loose when pushed up by insulation-displacement-contact pins.

SUMMARY OF THE INVENTION

Accordingly, it is an object of the present invention to provide an insulation-displacement-contact connector which costs less than a pin-to-pin-contact connector and is reliable enough to hold wires tight so that the wires will not get loose when pushed up by insulation-displacement-contact pins.

An insulation-displacement-contact connector according to the present invention comprises a first frame, a second frame, and tabs. The first and second frames pinch electric wires tight between them. The first frame has an opening so that the insulation-displacement-contact pins of a mating material can pass through and touch the wires. The tabs, which may be either on the first or the second frame, extend outwardly at an angle.

When the first and second frames are assembled together with electric wires between them, the wires are bent by the tabs. The wires are held more securely because of increased friction at the bent portions of the wires and can reliably withstand the pushing force exerted by the insulation-displacement-contact pins which touch the wires through the opening in the first frame when the connector is attached in place. The wires are stretched more tightly as they are bent by the tabs, and this makes electrical contact between the pins and the wires easier and more reliable. The connector has no pins but only holds wires in it. Reduced number of components means reduced cost.

If the tabs are integral parts of the second frame and extend downwardly to bend wires at right angles, they can cover both the bent portions of the wires and the mating portion of the mating material for protection.

If the tabs extend outwardly at an angle, bending stress to the wires can be lessened.

The second frame may have an opening in it such that the opening is on top of the opening of the first frame when the first and second frames are locked together. With this arrangement, you can inspect through the opening how the insulation-displacement-contact pins engage with the wires.

DESCRIPTION OF THE PREFERRED EMBODIMENTS

A preferred embodiment of the present invention is described below.

Figure 1:
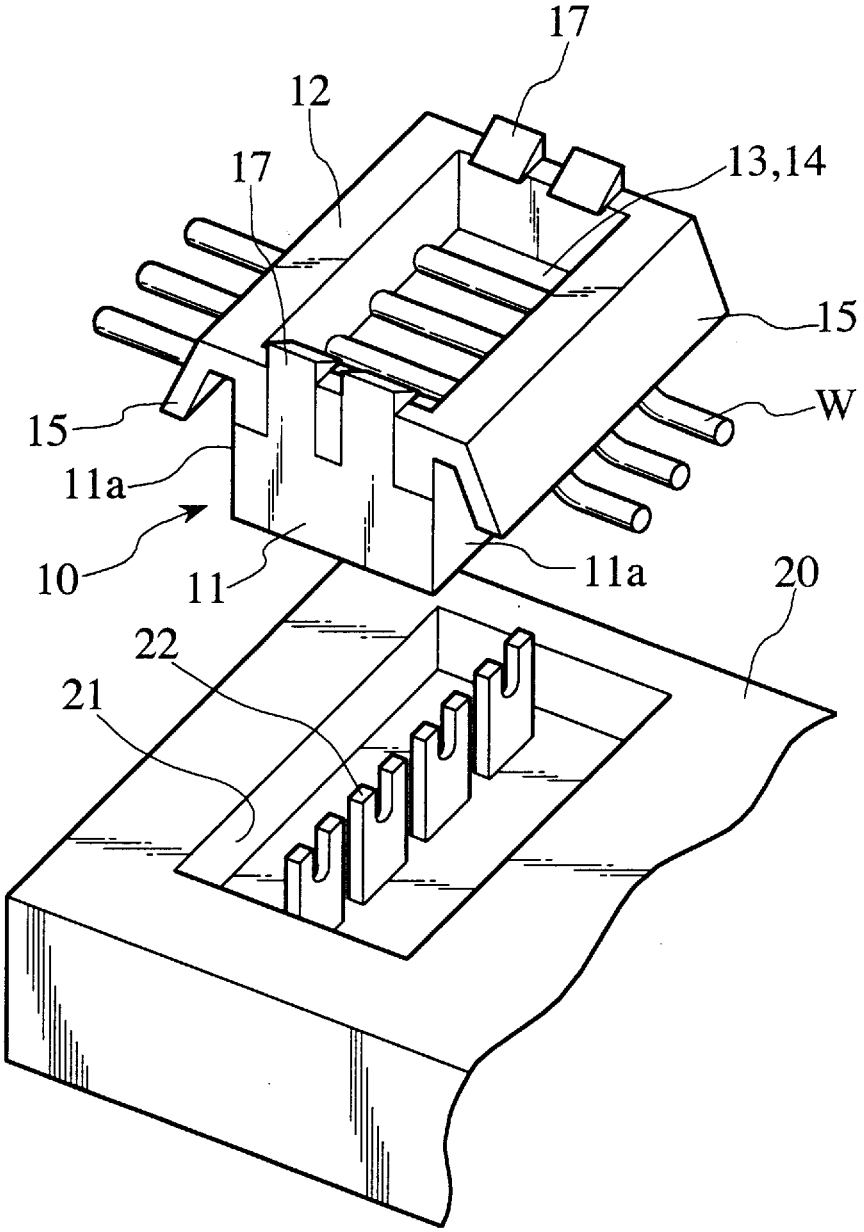
FIG. 1 is a perspective view of a connector according to the present invention which is being mated with a mating material.
Figure 3:
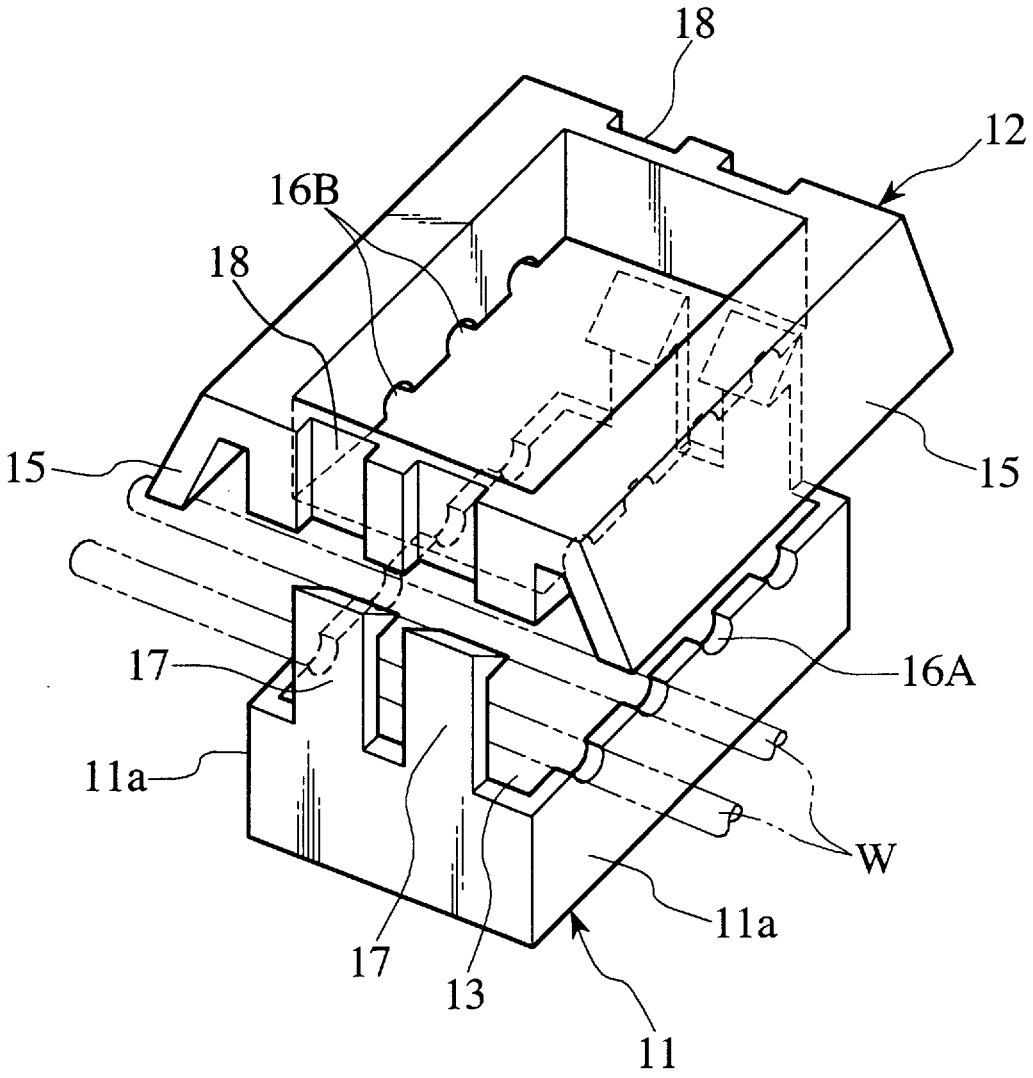
FIG. 3 is an exploded perspective view of a connector according to the present invention which is disassembled to receive electric wires in it.

Referring to FIGS. 1 and 3, an insulation-displacement-contact connector 10 comprises separate two parts, one being a first frame 11 (lower part) and the other being a second frame 12 (upper part). The frames 11 and 12 have latches 17 and latch receiving means 18 respectively to lock themselves tight when assembled together. An electrical junction box 20 (mating connector) has a recess on it which serves as a female connector 21. The frames 11 and 12 are assembled together to form the insulation-displacement-contact connector 10 which is designed to mate with the female connector 21 of the electrical junction box 20.

Figure 2:
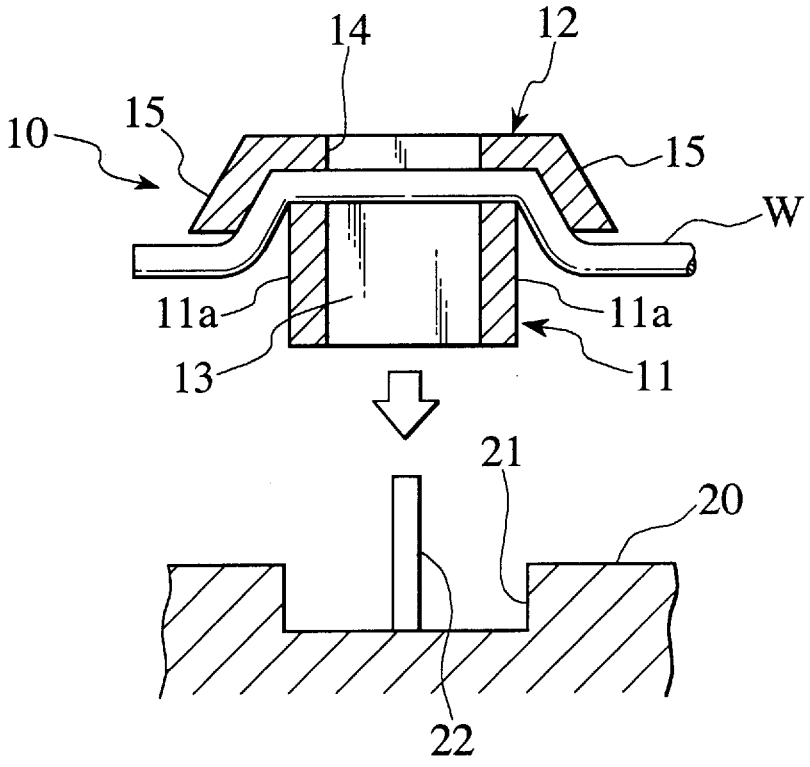
FIG. 2 is a cross-sectional view of the connector and the mating material shown in FIG. 1.

The frames 11 and 12 are designed to pinch electric wires W between them when assembled together. As shown in FIG. 2, the first frame 11 has an opening 13 in it to allow the insulation-displacement-contact pins 22 of the female connector 21 to pass through. The second frame 12 has an opening 14 the size and shape of which are about the same as those of the opening 13. The opening 14 is on top of the opening 13 of the first frame 11 when the first and second frames 11,12 are assembled together.

Electric wires W are placed over the first frame 11 crossing the opening 13. Then the second frame 12 is placed over and locked together with the first frame 11 pinching the wires W between them. To ease the pinching stress to the wires W, the frames 11 and 12 have semicircular recesses 16A and 16B on their contacting surfaces.

The second frame 12 has tabs 15 on its sides extending outwardly toward the first frame 11 at an angle so that the wires W as pinched between the frames 11 and 12 are bent along the outer surface 11a of the first frame 11 by the tabs 15.

Now benefits from the present invention are described below.

When the frames 11 and 12 are assembled together to form a insulation-displacement-contact connector pinching electric wires W between them, portions of the wires W outside the first frame 11 are bent at an angle by the tabs 15. The wires W are held more securely because of increased friction at their bent portions and can reliably withstand the pushing force exerted by the insulation-displacement-contact pins 22 which touch the wires W through the opening 13 when the connector 10 is attached in place. The wires W are stretched more tightly as they are bent by the tabs 15, and this makes electrical contact between the pins 22 and the wires W easier and more reliable.

Because the tabs 15 extend outwardly at an angle, the wires W are bent at a comfortable angle without excessive stress, and the tabs 15 can cover both the bent portions of the wires W and the mating portion of the female connector 21 to protect them.

Because the second frame 12 has an opening 14 in it, how the insulation-displacement-contact pins 22 contact with the wires W can be checked through the opening 14.

While the preferred embodiment thus far described has the tabs 15 on the second frame 12, it is understood that the tabs can be on the first frame 11 to bend the wires W.

What is claimed is:

1. An insulation-displacement-contact connector for electrical connection of insulated electric wires to a mating connector having insulation-displacement-connecting pins, comprising:

a first frame having an opening therein so that the insulation-displacement-contact pins of the mating connector pass through said opening;

a second frame lockable to said first frame, the electric wires extending across said opening and being pinched between said first and second frames when locked to each other; and tabs on one of said first and second frames to bend exposed portions of said electric wires along outside surfaces of the other of said first and second frames when locked to each other.

2. An insulation-displacement-contact connector as defined in claim 1, wherein said tabs are provided on said second frame and extend toward said first frame.

3. An insulation-displacement-contact connector as defined in claim 1, wherein said tabs extend toward the other of said first and second frames at an angle.

4. An insulation-displacement-contact connector as defined in claim 1, wherein said second frame has an opening therein aligned with the opening of said first frame when said first and second frames are locked to each other.

5. An insulation-displacement-contact connector for electrical connection of a connecting portion of an insulated electric wire to an insulation-displacement-connecting pin in a mating connector capable of being attached to the insulation-displacement-contact connector, the insulation-displacement-contact connector comprising:

a first frame having an opening therein so that the insulation-displacement-contact pin of the mating connector passes through the opening, the first frame having two first pinching portions;

a second frame lockable to the first frame, the second frame having two second pinching portions, each corresponding to the respective first pinching portions, the electric wire extending across the opening and being pinched between the first and second pinching portions so that the connecting portion is disposed on the opening when the first and second frames are locked each other, the connecting portion being connected to the insulation-displacement-connection pin when the first and second frames, locked to each other, are attached to the mating connector; and tabs on one of the first and second frames to bend exposed portions of the electric wire along outside surfaces of the other of the first and second frames when locked to each other.

6. An insulation-displacement-contact connector as defined in claim 5, wherein the tabs are provided on the second frame and extend toward the first frame.

7. An insulation-displacement-contact connector as defined in claim 5, wherein the tabs extend toward the other of the first and second frames at an angle.

8. An insulation-displacement-contact connector as defined in claim 5, wherein the second frame has an opening therein which aligns with the opening of the first frame when the first and second frames are locked each other.

* * * * *

UNITED STATES PATENT AND TRADEMARK OFFICE

CERTIFICATE OF CORRECTION

PATENT NO. : 5,890,924
DATED : April 6, 1999
INVENTOR(S) : Endo et al.

It is certified that error appears in the above-identified patent and that said Letters Patent is hereby corrected as shown below:

In Claim 1, column 3, lines 12-13, after "wires", delete "to a mating connector having insulation-displacement-connecting pins".

In Claim 1, column 3, line 14, after "comprising:", insert the line --a mating connector having insulation-displacement-connecting pins;--.

In Claim 1, column 3, line 15, after "therein", insert --and receivable on the mating connector--.

In Claim 5, column 4, line 1, after "wire", insert --,--; and in lines 1-4, delete"to an insulation-displacement-connecting pin in a mating connector capable of being attached to the insulation-displacement-contact connector, the insulation-displacement-contact connector".

In Claim 5, column 4, line 4, after "comprising:", insert the line --an insulation-displacement-connecting pin in a mating connector capable of being attached to the insulation-displacement-contact connector;--.

In Claim 5, column 4, line 17, after "locked", insert --to--.

UNITED STATES PATENT AND TRADEMARK OFFICE

CERTIFICATE OF CORRECTION

PATENT NO. : 5,890,924

DATED : April 6, 1999

INVENTOR(S) : Endo et al.

It is certified that error appears in the above-identified patent and that said Letters Patent is hereby corrected as shown below:

In Claim 8, column 4, line 36, after "locked", insert --to--.

Signed and Sealed this

Twenty-first Day of March, 2000

*Attest:*

*Attesting Officer*

Q. TODD DICKINSON

*Commissioner of Patents and Trademarks*